US006291375B1

(12) United States Patent
Allen et al.

(10) Patent No.: US 6,291,375 B1
(45) **Date of Patent: *Sep. 18, 2001**

(54) TEXTILE FABRIC FOR DISSIPATING ELECTRICAL CHARGES

(75) Inventors: Hilda E. Allen; John H. Beason; Dennis D. Leet, all of Greensboro, NC (US)

(73) Assignee: Guilford Mills, Inc., Greensboro, NC (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/182,846

(22) Filed: Oct. 29, 1998

(51) Int. Cl.[7] ..... D04B 11/12; D04B 21/12; D04B 21/14; D04B 1/14; D04B 1/00

(52) U.S. Cl. ..... 442/308; 66/170; 66/202; 442/313

(58) Field of Search ..... 66/202, 195, 169, 66/194, 170; 2/48, 93; 139/425 R; 5/334 R; 442/59, 313, 308

(56) References Cited

U.S. PATENT DOCUMENTS

| | | |
|---|---|---|
| 2,670,620 | 3/1954 | Goldstaub . |
| 3,586,597 | 6/1971 | Okuhashi . |
| 3,806,959 | 4/1974 | Gross . |
| 3,986,530 | 10/1976 | Mackawa . |
| 4,322,232 | 3/1982 | Beane . |
| 4,335,589 | 6/1982 | Flasher . |
| 4,606,968 | 8/1986 | Thornton et al. . |
| 4,668,545 | 5/1987 | Lowe . |
| 4,672,825 | 6/1987 | Yasukawa et al. . |
| 4,753,088 | 6/1988 | Harrison et al. . |
| 4,856,299 | 8/1989 | Bryant . |
| 4,878,148 | 10/1989 | Hee . |
| 4,921,751 | 5/1990 | Wakahara et al. . |

*Primary Examiner*—Blaine Copenheaver
*Assistant Examiner*—Christopher C. Pratt
(74) *Attorney, Agent, or Firm*—Kennedy Covington Lobdell & Hickman, LLP

(57) ABSTRACT

A textile fabric for dissipating electrostatic charges achieves remarkably low surface resistivity by forming into a fabric ground structure a matrix of electrically conducted yarns wherein electrical connections between the yarns are made by plural successive interconnections of two electrically conductive yarns, e.g., by plating electrically conductive yarns across multiple successive stitches in a knitted fabric ground structure.

13 Claims, 4 Drawing Sheets

| Fabric | | | | | | | | |
|---|---|---|---|---|---|---|---|---|
| | **Fabric of Present Invention** | **Warp Knitted Fabric No. 1** | **Warp Knitted Fabric No. 2** | **Warp Knitted Fabric No. 3** | **Warp Knitted Fabric No. 4** | **Warp Knitted Fabric No. 5** | **Woven Fabric No. 1** | **Woven Fabric No. 2** |
| Lengthwise at Fabric Front (Technical Face) | $10^5$ (100,000) | $10^6$ (1,000,000) | $7.9 \times 10^6$ (7,900,000) | $9.0 \times 10^5$ (900,000) | $6.5 \times 10^5$ (650,000) | $6.5 \times 10^7$ (65,000,000) | $10^{13}$ (10 Trillion) | $10^{13}$ (10 Trillion) |
| Widthwise at Fabric Front (Coursewise at Technical Face) | $10^5$ (100,000) | $10^6$ (1,000,000) | $9.0 \times 10^5$ (900,000) | $7.9 \times 10^5$ (790,000) | $6.5 \times 10^5$ (650,000) | $10^6$ (1,000,000) | $10^{13}$ (10 Trillion) | $10^{13}$ (10 Trillion) |
| Lengthwise at Fabric Back (Walewise at Technical Back) | $10^5$ (100,000) | $4.5 \times 10^5$ (450,000) | $6.5 \times 10^6$ (6,500,000) | $10^6$ (1,000,000) | $4.5 \text{ X } 10^5$ (450,000) | $4.5 \text{ X } 10^7$ (45,000,000) | $10^{13}$ (10 Trillion) | $10^{13}$ (10 Trillion) |
| Widthwise at Fabric Back (Coursewise at Technical Back) | $10^5$ (100,000) | $4.5 \times 10^5$ (450,000) | $6.5 \times 10^5$ (650,000) | $6.5 \times 10^5$ (650,000) | $4.5 \times 10^5$ (450,000) | $7.9 \times 10^5$ (790,000) | $10^{13}$ (10 Trillion) | $10^{13}$ (10 Trillion) |

Fig. 3A

Fig. 3B

Key:

Fabric of Present Invention = Preferred Embodiment of Figs. 1 and 2

Warp Knitted Fabric No. 1 = Bar 1 (45 denier, 24 filament semidull polyester) 1-0, 3-4
Bar 2 (45 denier, 24 filament semidull polyester) 1-2, 1-0
Bar 3 (44 denier monofilament carbon suffused nylon) 1-0, 1-2, 2-3, 3-4, 4-5, 4-3, 3-2, 2-1
Bar 4 (44 denier monofilament carbon suffused nylon) 4-5, 4-3, 3-2, 2-1, 1-0, 1-2, 2-3, 3-4

Warp Knitted Fabric No. 2 = Bar 1 (78 denier, 34 filament semidull polyester) 1-0, 4-5
Bar 2 (22 denier, monofilament carbon suffused nylon) 12-12, 12-13, 11-11, 10-10, 10-9, 9-8, 8-8, 8-7, 6-6, 6-5, 4-4, 4-3, 2-2, 2-1, 0-1, 2-2, 2-3, 4-4, 4-5, 6-6, 6-7, 8-8, 8-9, 10-10, 10-11
Bar 3 (22 denier, monofilament carbon suffused nylon) 1-0, 1-2, 3-3, 3-4, 5-5, 5-6, 7-7, 7-8, 9-9, 9-10, 11-11, 12-12, 13-12, 11-11, 11-10, 9-9, 9-8, 7-7, 7-6, 5-5, 5-4, 3-3, 3-2, 1-1
Bar 4 (40 denier, 30 filament carbon suffused polyester) 1-0, 0-1

Warp Knitted Fabric No. 3 = Bar 1 (40 denier, 30 filament polyester) )
Bar 2 (22 denier monofilament carbon suffused nylon) )
Bar 3 (22 denier monofilament carbon suffused nylon) )
Bar 4 (40 denier, 30 filament carbon suffused polyester)
} Stitch Patterns are same as Warp Knitted Fabric No. 2

Warp Knitted Fabric No. 4 = Bar 1 (78 denier, 34 filament semidull polyester) 4-5, 1-0
Bar 2 (78 denier, 34 filament semidull polyester) 1-0, 0-1
Bar 3 (22 denier, monofilament carbon suffused nylon) 3-4, 3-2, 2-1, 1-0, 1-2, 2-3
Bar 4 (22 denier, monofilament carbon suffused nylon) 1-0, 1-2, 2-3, 3-4, 3-2, 2-1

Warp Knitted Fabric No. 5 = Bar 1 (78 denier, 34 filament semidull polyester) }
Bar 2 (22 denier, monofilament carbon suffused nylon) }
Bar 3 (22 denier, monofilament carbon suffused nylon) }
Bar 4 (40 denier, 30 filament carbon suffused polyester)}
Stitch patterns are same as Warp Knitted Fabric No. 2

Woven Fabric No. 1 = Warp (75 denier, 34 filament polyester)
Filling (80 denier, 34 filament polyester)
Electrically Conductive Warp and Filling (80 denier, 36 filaments polyester, 6 filaments carbon)
One-by-one weave Woven Fabric No. 2 = Warp (80 denier, 34 filament polyester)
Filling (80 denier, 34 filament polyester)
Electrically Conductive Warp and Filling (100 denier, 75 filaments polyester, 6 filaments carbon)
One-by-one weave

TEXTILE FABRIC FOR DISSIPATING ELECTRICAL CHARGES

BACKGROUND OF THE INVENTION

The present invention relates generally to textile fabrics and, more particularly, to textile fabrics incorporating electrically conductive yarns so as to be capable of conducting electrical current sufficiently for dissipating electrical charges.

The tendency of electrostatic charges to be generated by frictional contact with textile fabrics is well known. In particular, it is common for wearing apparel to become charged with static electricity from frictional contact with a wearer's skin or with other fabrics or garments resulting from normal body movements of the wearer. Static electricity also tends to accumulate on clothing as a result of walking on carpets and other non-conductive floor coverings.

The accumulation of such electrostatic charges normally is little more than an annoyance, causing clothing items to cling to one another or to the wearer's body and to periodically deliver minor shocks to the person when touching a grounded object or surface. In some environments, however, the accumulation of static electricity on clothing can pose a significant danger. For example, for persons working with or near flammable or explosive materials, the arcing or sparking which results from the discharge of static electricity from a person to a grounded object can potentially ignite or combust such materials. Likewise, in environments wherein microelectronic equipment such as miniaturized circuit boards or like electrically sensitive components are being manufactured or assembled, the discharge of static electricity can potentially damage the equipment.

Accordingly, considerable effort has been undertaken within the textile industry over recent decades toward the object of developing textile fabrics which resist the accumulation of static electrical charges and/or have improved capabilities of continually dissipating such charges so as to alleviate the above-discussed dangers and annoyances. Toward this end, various forms of electrically conductive yarns and various constructions of textile fabrics utilizing such yarns have been developed. Much of the development work with electrically conductive yarns has been performed with synthetic yarns wherein electrically conductive particles such as carbon particles are mixed with an extrudate to become suffused into filaments extruded from the material, thereby to render the extruded filaments electrically conductive. One of the most common forms of electrostatic dissipation fabrics incorporates such yarns at regular spacings in both the warp and weft of a woven fabric, typically a one-by-one weave. In this manner, the electrically conductive warp and weft yarns make electrical contact with one another at their various crossing points, thereby creating a regular checkerboard matrix by which electrostatic charges can be electrically conducted across the fabric. More recently, warp knitted fabrics have been developed which incorporate two sets of such conductive yarns formed in opposed lapping patterns by which the conductive yarns extend diagonally through the fabric to create a diamond-like or argyle-like pattern. In similar manner to the aforedescribed woven fabric, the electrically conductive yarns are thereby electrically connected with one another at the respective connecting points to collectively form a matrix for conducting away electrostatic charges across the fabric. These and other electrically conductive yarns and electrostatic dissipation fabrics are described and disclosed in U.S. Pat. Nos. 3,586,597; 3,806,959; 3,986,530; 4,322,232; 4,335,589; 4,606,968; 4,668,545; 4,672,825; 4,753,088; 4,856,299; 4,878,148; and 4,921,751.

It is understood that the resistivity of such fabrics to the conduction of electrical charges directly affects the effectiveness of the fabrics in dissipating static electricity. As the resistivity of an electrical conductor decreases, the ability of electricity to flow freely through the conductor commensurately increases. While the known electrostatic dissipation fabrics are generally effective for their intended purpose, the resistivity values of such fabrics are higher than would be preferred, despite the fact that known electrically conductive yarns have resistivity values within desirable ranges. Accordingly, a need exists for improvements in the construction of textile fabrics used for dissipating static electricity to obtain lower resistivity values and thereby achieve greater effectiveness in dissipating electrostatic charges.

SUMMARY OF THE INVENTION

Fundamentally, the present invention is based upon the theorization that improved conductivity of electricity within electrostatic dissipation fabrics can be achieved by enhancing the electrical contact between electrically conductive yarns in such fabrics at the points at which such yarns intersect with one another. A more specific premise of the present invention is the theory that the resistivity of known electrostatic dissipation fabrics of the type described above is negatively affected by the provision in such fabrics of only point-type contact between electrically conductive yarns at such intersections, i.e., the mere crossing contact between electrically conductive yarns in woven fabrics and the mere interlooping of electrically conductive yarns within only single spaced stitches in knitted fabrics.

In contrast to the known fabrics, the present invention contemplates the creation of a textile fabric for dissipating static electricity and like electrical charges via a fabric structure of interconnected yarns wherein electrically conductive yarns intersect with one another in a pattern by which at least some of the intersections between the electrically conductive yarns comprise plural successive interconnections of two electrically conductive yarns within the fabric structure. The intersections between the electrically conductive yarns provide electrical contact of such yarns with one another to form a matrix for conducting electrical charges to be dissipated, with the intersections being elongated, i.e., extending beyond a point contact crossing or a single stitch between two electrically conductive yarns, e.g., the intersections having plural successive interconnections of electrically conductive yarns, thereby effectively enhancing the electrical conductivity between such yarns. The overall resistivity of the electrically conductive matrix formed within such fabrics should be significantly lower than with the known conventional fabrics described above.

While the present invention is not intended to be limited to any particular fabric structure or construction, nor to any particular matrix pattern by which the electrically conductive yarns are incorporated into the fabric, a warp knitted fabric construction is presently contemplated as a preferred embodiment of the invention. Briefly summarized, the warp knitted textile fabric comprises a knitted structure of yarns formed in loops interknitted with one another in wales oriented longitudinally along a lengthwise extent of the fabric and courses oriented transversely along a widthwise extent of the fabric. The fabric includes a plurality of electrically conductive yarns contained within the knitted structure in a pattern wherein the electrically conductive yarns intersect in electrical contact with one another to form the aforementioned matrix for conducting electrical charges to be dissipated. At least some of the intersections between the electrically conductive yarns, and preferably each of such intersections, extend across a plurality of adjacent loops in the knitted structure to achieve enhanced conductivity between the electrically conductive yarns.

It is contemplated that substantially any electrically conductive yarns may be utilized in the present invention, including known yarns which comprise electrically conductive particles or like elements distributed within a textile fiber or fibers. In this connection, the term "yarn" as used herein is intended and to be understood in its broadest sense to include, without limitation, any elongated strand material of indefinite or indeterminant length suitable for interconnection with other yarns into a textile fabric structure, regardless of the material, composition, or fabrication of such yarns. For example, a synthetic polymeric fiber having electrically conductive particles such as carbon particles suffused within the polymeric material has the advantage of being readily available commercially. Alternatively, it is conceivable to use spun yarns with metallic fibers distributed therein or even to utilize wire-like metallic strands.

The knitted structure of the present fabric preferably has sufficient dimensional stability to resist distortion beyond any extent which would substantially reduce the electrical conductivity between the electrically conductive yarns. It is further preferred that each intersection between the electrically conductive yarns extend across the interknitted loops of a plurality of successive courses, within which intersections the electrically conductive yarns are interknitted with one another. In this manner, the electrically conductive yarns are intimately contacted with one another over the full extent of the loops within the successive courses, as opposed to the mere point-contact or single-stitch contact in known fabrics.

One advantageous warp knitted structure for the present fabric is of a multi-bar construction having two sets of ground yarns warp knitted in substantially every wale and course in a dimensionally stable stitch pattern and two sets of electrically conductive yarns warp knitted in only selected spaced wales and courses. Specifically, one set of the ground yarns is warp knitted in a repeating 1-0, 3-4 stitch pattern, while the other set of ground yarns is warp knitted in a repeating 1-2, 1-0 stitch pattern. One set of the electrically conductive yarns is warp knitted in a repeating (1-0, 0-1)×2, 1-2, 2-3, (3-4, 4-3)×2, 3-2, 2-1 stitch pattern, while the other set of electrically conductive yarns is warp knitted in a repeating (3-4, 4-3)×2, 3-2, 2-1, (1-0, 0-1)×2, 1-2, 2-3 stitch pattern.

Other aspects, features and advantages of the present invention will be understood and will become apparent to those persons skilled in the art from the description hereinbelow of a preferred embodiment with reference to the accompanying drawings.

BRIEF DESCRIPTION OF THE DRAWINGS

FIG. 3A is a chart compiling empirical data from resistivity testing of the knitted fabric of FIG. 1 in comparison with known electrostatic dissipation fabrics, and FIG. 3B is a key for the data of FIG. 3A.

DESCRIPTION OF THE PREFERRED EMBODIMENT

As explained more fully herein, the fabric of the present invention is formed on a warp knitting machine which may be of any conventional type of an at least four-bar construction having four or more yarn guide bars and a needle bar, e.g., a conventional tricot warp knitting machine. The construction and operation of such machines are well-known in the knitting art and need not herein be specifically described and illustrated. In the following description, the yarn guide bars of the knitting machine are identified as "top", "upper middle", "lower middle", and "bottom" guide bars for reference purposes only and not by way of limitation. As those persons skilled in the art will understand, such terms equally identify knitting machines whose guide bars may be referred to as "front", "middle" and "back" guide bars, which machines of course are not to be excluded from the scope and substance of the present invention. As further used herein, the "bar construction" of a warp knitting machine refers to the number of yarn guide bars of the machine, while the "bar construction" of a warp knitted fabric refers to the number of different sets of warp yarns included in the fabric, all as is conventional terminology in the art.

Figure 1:
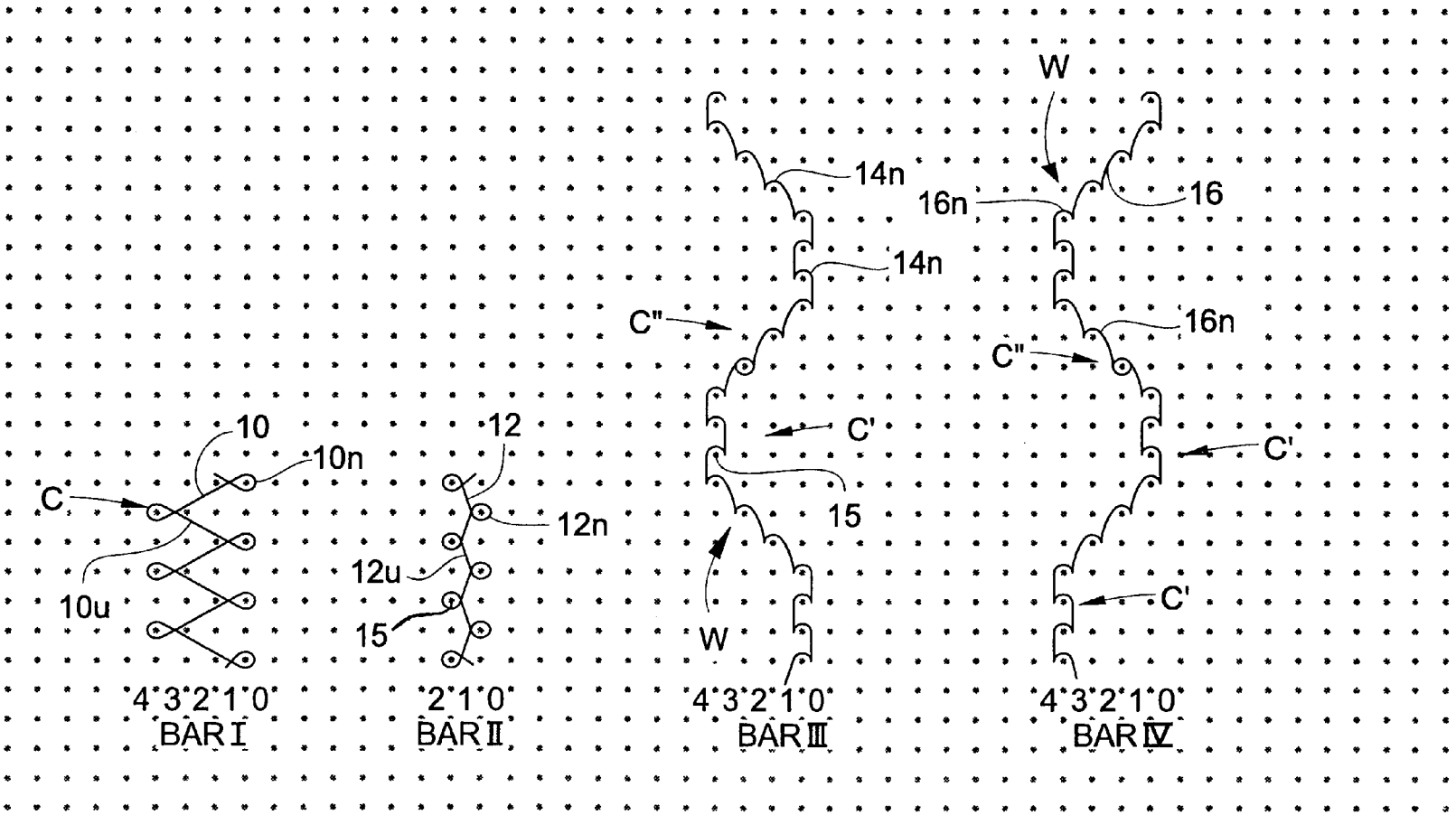
FIG. 1 is a diagram showing individually the stitch patterns for the ground and electrically conductive yarns carried out by a warp knitting machine in knitting one preferred embodiment of an electrostatic dissipation fabric according to the present invention.

As is conventional, the needle bar of the warp knitting machine carries a series of aligned knitting needles, while each guide bar of the machine carries a series of guide eyes, the needle and guide bars of the machine preferably having the same gauge, i.e., the same number of needles and guide eyes per inch. According to the embodiment of the present fabric illustrated in FIG. 1, the bottom (or back) guide bar I is threaded on every guide eye with a set of yarns 10 delivered from a respective warp beam (not shown), and the lower middle yarn guide bar II of the machine is likewise threaded on every guide eye with another set of yarns 12 delivered from another warp beam (also not shown), suitable for formation of a ground structure for the fabric. The upper middle guide bar III is threaded with a third set of yarns 14 from a third warp beam (also not shown) in a so-called one-in, five-out pattern, i.e., one yarn being delivered to one guide with the next five adjacent guide eyes being left empty, and so on in continuing alternation along the length of the guide bar. The top (or front) guide bar IV is similarly threaded with the fourth set of yarns 16 from a fourth warp beam (also not shown) in the same one-in, five-out pattern. As described hereinafter, the yarns 14,16 are electrically conductive and serve to form a matrix in the fabric for dissipating electrostatic charges. As will be explained, the threading arrangement of the four guide bars is set up in conjunction with the stitch patterns of the four sets of yarns to achieve the desired electrically conductive matrix.

Preferably, all of the ground yarns 10,12, are multifilament synthetic yarns, e.g., polyester, but may be of differing denier and filament makeup. For example, in the preferred embodiment depicted in FIG. 1, the ground yarns are a 40 denier, 24 filament semi-dull polyester yarn. Of course, those persons skilled in the art will recognize that various other types of ground yarns may also be employed as necessary or desirable according to the fabric weight, feel, and other characteristics sought to be achieved, the principal requirement of the ground yarns being that they must be electrically insulative so as not to impair the ability of the electrically conductive yarns 14,16 to conduct electricity.

As indicated, all of the yarns 14,16 are adapted to be electrically conductive. While the present invention contemplates that substantially any electrically conductive yarn, now known or hereafter coming into existence, may be utilized in the textile fabric of the present invention, it is presently preferred that the electrically conductive yarns 14,16 are extruded monofilament synthetic polymeric yarns having electrically conductive particles suffused or otherwise distributed throughout the polymeric material, e.g., a 44 denier monofilament nylon yarn uniformly suffused with electrically conductive carbon particles.

Referring now to the accompanying drawings, one particular embodiment of the present warp knitted fabric of a four-bar construction knitted according to the present invention on a four-bar warp knitting machine, is illustrated. In the accompanying drawings, the stitch constructions of the ground and electrically conductive yarns as carried out by the respective lateral traversing movements of the guide bars of the knitting machine according to such embodiment of the present fabric, are respectively illustrated individually in a traditional dot or point diagram format, wherein the individual points 15 represent the needles of the needle bar of the knitting machine in the formation of several successive fabric courses C across several successive fabric wales W.

According to this embodiment, the bottom guide bar of the machine manipulates the ground yarns 10 to traverse laterally back and forth relative to the needles 15 of the needle bar of the machine to stitch the ground yarns 10 in a repeating 1-0,3-4 stitch pattern (diagrammatically indicated at I of FIG. 1) as the ground yarns 10 are fed progressively from their respective warp beam. Simultaneously, the lower middle guide bar of the knitting machine manipulates the ground yarns 12 as they are fed from their respective warp beam to traverse relative to the needles 15 to stitch the ground yarns 12 in a repeating 1-2,1-0 stitch pattern (diagrammatically indicated at II of FIG. 1). At the same time, the lower middle guide bar of the machine manipulates the electrically conductive yarns 14 as they are fed from their respective warp beam to traverse relative to the needles 15 to stitch the electrically conductive yarns 14 in a repeating (1-0,0-1)×2, 1-2,2-3, (3-4,4-3)×2, 3-2,2-1 stitch pattern at six needle spacings in the same one-in, five-out alternation as the threading of the yarns on the upper middle guide bar, as indicated at III of FIG. 1. Similarly, the top guide bar of the machine manipulates the other set of electrically conductive yarns 16 as they are fed from their respective warp beam to traverse relative to the needles 15 to stitch the electrically conductive yarns 16 in a repeating (3-4,4-3)×2, 3-2,2-1, (1-0,0-1)×2, 1-2,2-3 stitch pattern also at six needle spacings according to the one-in, five-out threading of such yarns, as indicated at IV of FIG. 1.

As will thus be understood, the ground yarns 10,12 are interknitted with one another in the described stitch constructions with each other ground yarn 10,12 being formed from one fabric course C to the next fabric course C in respective series of needle loops **10*n*,12*n*, and in connecting underlaps 10*u*,12*u*, extending between the successive needle loops 10*n*,12*n*, whereby according to the stitch pattern and the threading pattern of the ground yarns 10,12, the needle loops 10*n*,12*n* appear in substantially every wale W of every course C in the fabric. Each electrically conductive yarns 14 is formed in needle loops 14*n* interknitted in plated relation with the needle loops 10*n*,12*n* of the ground yarns 10,12 in every sixth wale W of every course C. Similarly, each electrically conductive yarn 16 is formed in needle loops 16*n* interknitted in plated relation with the needle loops 10*n*,12*n* of the ground yarns 10 in every sixth wale W of every course C. Due to the mirror-image stitch patterns followed by the respective electrically conductive yarns 14,16 as depicted at III and IV of FIG. 1, the respective electrically conductive yarns are also interknitted in plated relationship with one another within every sixth wale W of spaced groups of courses C' each group spanning four successive courses and separated from adjacent groups by two successive intervening courses C", as depicted in FIG. 2**.

In this manner, the ground yarns 10,12 form a base or substrate to the fabric with the electrically conductive yarns 14,16 appearing predominantly at the technical face of the fabric. As a result of the respective stitch patterns executed by the ground yarns 10,12, the base or substrate of the fabric thereby formed has a high degree of dimensional stability against stretching and distortion, the coursewise underlaps **10*u* of the ground yarns 10 serving to restrict coursewise stretching or distortion of the fabric while the walewise underlaps 12*u* of the ground yarns 12 serve to restrict walewise stretching or distortion of the fabric. As above indicated, the opposing mirror-image stitch patterns followed by the electrically conductive yarns 14,16 cause such yarns to collectively form a hexagonal matrix within the ground structure of the ground yarns 10,12, wherein each cooperating pair of electrically conductive yarns 14,16 define a series of hexagons aligned and extending walewise along the longitudinal extent of the fabric with the multiple hexagons defined collectively by all of the electrically conductive yarns 14,16 being arranged in a staggered array throughout the lengthwise and widthwise extent of the fabric and interconnected with one another widthwise and lengthwise at respective intersections formed by the respective series of needle loops 14*n*,16*n*** which are plated with one another.

Figure 2:
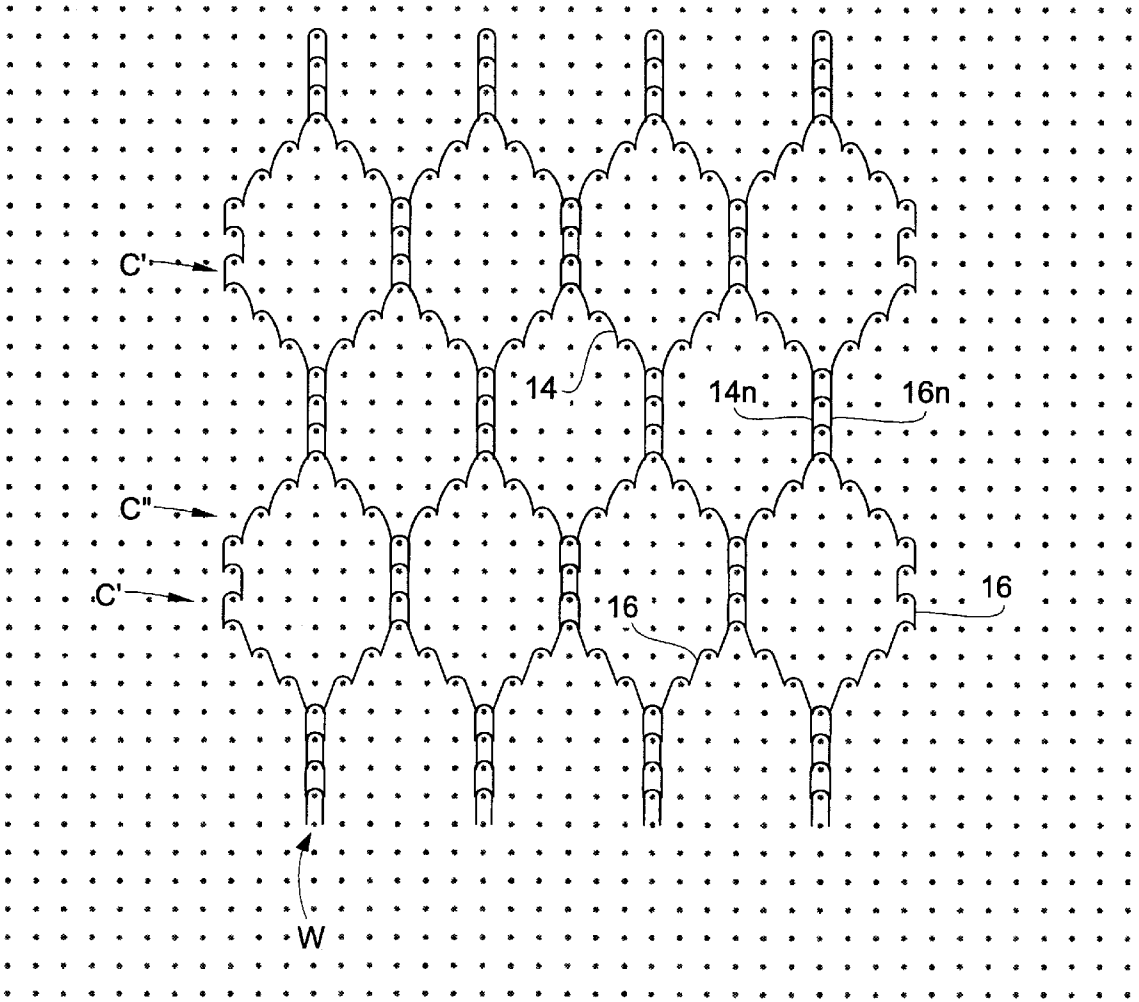
FIG. 2 is another diagram, similar to FIG. 1, showing the interconnecting relationship between the two sets of electrically conductive yarns in the knitted fabric of FIG. 1.

This matrix formed by the electrically conductive yarns 14,16 may be seen and understood in FIG. 2 wherein the knitted relationship between multiple electrically conductive yarns 14,16 is depicted. As will be understood, the various intersections between the electrically conductive yarns 14,16 formed at the locations at which their respective needle loops **14*n*,16*n* are plated with one another insure that the electrically conductive yarns make secure electrical contact with one another whereby the matrix of such yarns is well adapted to conduct electrical charges such as static electricity across the ground structure of the fabric thereby to dissipate such charges and minimize if not eliminate the build-up of such charges within the fabric. By virtue of each intersection between the electrically conductive yarns 14,16** being formed by a series of four successively plated stitches of such yarns, the electrical connection is substantially more secure and reliable than in known electrically conductive fabrics such as those described above wherein electrically conductive yarns make contact with one another only within a single stitch or otherwise only in the form of a point contact.

The resistivity of fabrics made according to the present invention is surprisingly reduced dramatically in comparison to known electrically conductive fabrics. By way of example, an electrically conductive fabric in accordance with the present invention constructed in the preferred embodiment described above, i.e., utilizing 40 denier, 24 filament semi-dull polyester ground yarns and 44 denier monofilament carbon suffused nylon as the electrically conductive yarns warp knitted in the preferred stitch patterns depicted in FIG. 1 was tested for surface resistivity using a conventional TREK Model 150 Precision Surface Resistivity Meter and found to have a resistivity of only $10^5$ (100,000) ohms per square in both lengthwise and widthwise directions at both the technical face and technical back of the fabric. In comparison, a conventional four-bar fabric warp knitted in the known "argyle" diamond-pattern of electrically conductive yarns utilizing 45 denier, 24 filament semi-dull polyester ground yarns knit in the identical ground construction of Bars I and II of FIG. 1, and 44 denier monofilament carbon suffused nylon as the electrically conductive yarns knit on Bar III in a repeating 1-0,1-2,2-3,3-4,4-5,4-3,3-2,2-1 stitch pattern and on Bar IV in a repeating 4-5,4-3,3-2,2-1,1-0,1-2,2-3,3-4 stitch pattern was found to have a surface resistivity of $10^6$ (1,000,000) ohms per square when similarly measured lengthwise and widthwise at the technical face of the fabric and to have a surface resistivity of $4.5\times10^5$ (450,000) ohms per square when measured lengthwise and widthwise across the technical back of the fabric.

By further comparison, other known warp knitted fabrics having electrically conductive yarns knitted in other "argyle" stitch patterns were found to have even substantially higher resistivity when comparably measured. Two known electrostatic dissipation fabrics woven in a one-by-one weave pattern with regularly spaced electrically conductive warp and weft yarns were found when comparably measured to have even substantially higher resistivity readings on the order of $10^{13}$ (10 trillion) ohms per square in both lengthwise and widthwise directions at both sides of the fabric. The specifications for such fabrics tested and the results of the resistivity measurements obtained are tabulated in greater detail in FIGS. 3A and 3B of the drawings.

The magnitude of the reduction in resistivity of the preferred embodiment of the present fabric in comparison to these known fabrics is remarkable and far exceeds any reduction in resistivity which might be expected. It is believed that the reduction in resistivity can only be attributed to the fundamental uniqueness of the fabric of the present invention in providing extended electrically connecting intersections between the respective electrically conductive yarns forming the overall dissipation matrix in the fabric. As persons skilled in the art will recognize and understand, it is believed that equally significant reductions in resistivity may be achieved in other electrostatic dissipation fabrics made utilizing differing stitch and threading patterns which still accomplish extended multi-stitch intersections between the electrically conductive yarns. It is further contemplated to be potentially possible to incorporate extended intersections between electrically conductive yarns in other forms of fabric construction, such as other forms of knitted fabrics and woven fabrics, so as to similarly achieve significant reductions in surface resistivity. These and other variations of the invention described herein are considered to be within the conceptual scope and substance of the present invention.

The advantages of fabrics made in accordance with the present invention are believed to be self-apparent. As will be recognized, as the surface resistivity of an electrostatic dissipation fabric is reduced, its ability to reliably conduct away static electricity and thereby resist the accumulation of static charges is correspondingly increased. The effectiveness of the fabric, in turn, in its intended uses, such as the fabrication of garments worn by persons in the handling of flammable or explosive substances or by persons engaged in manufacture or assembly of electrically sensitive electronic equipment, is greatly improved. It is equally important that the resistivity values of a fabric be generally uniform in both lengthwise and widthwise extent and at each opposite surface of the fabric, to insure that the ability of garments made with the fabric to dissipate electrostatic charges is not compromised or reduced as a result of the particular manner in which the fabric may be cut and sewn into a garment. The present invention not only achieves a dramatic reduction in surface resistivity over known fabrics, but is equally unique in achieving substantial uniformity and resistivity in each direction of each surface of the fabric.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A textile fabric capable of conducting electrical current sufficiently for dissipating electrical charges, the textile fabric comprising a knitted structure of yarns formed in loops successively interknitted with one another and aligned in wales oriented longitudinally along a lengthwise extent of the fabric and courses oriented transversely along a widthwise extent of the fabric, the fabric including a plurality of electrically conductive yarns contained within the knitted structure in a pattern wherein the electrically conductive yarns intersect in electrical contact with one another to form a matrix for conducting electrical charges to be dissipated, at least some of the intersections between the electrically conductive yarns comprising a plurality of knitted loops of each electrically conductive yarn successively interknitted with one another within successive courses of a common wale in the knitted structure for enhanced electrical conductivity between the electrically conductive yarns.

2. A textile fabric for dissipating electrical charges according to claim 1, wherein the yarns of the knitted structure are warp knitted with one another.

3. A textile fabric for dissipating electrical charges according to claim 1, wherein the yarns of the knitted structure are interknitted in a is dimensionally stable stitch pattern.

4. A textile fabric for dissipating electrical charges according to claim 1, wherein the electrically conductive yarns comprise textile fiber having electrically conductive elements substantially uniformly distributed therein.

5. A textile fabric for dissipating electrical charges according to claim 4, wherein the electrically conductive yarns comprise a synthetic polymeric fiber having the electrically conductive elements suffused therein.

6. A textile fabric for dissipating electrical charges according to claim 4, wherein the electrically conductive elements are carbon particles.

7. A textile fabric for dissipating electrical charges according to claim 1, wherein the electrically conductive yarns are interknitted with one another at the intersections therebetween.

8. A textile fabric for dissipating electrical charges according to claim 7, wherein the electrically conductive yarns are warp knitted with one another.

9. A textile fabric for dissipating electrical charges according to claim 1, wherein each intersection between the electrically conductive yarns extends across the interknitted loops of a plurality of successive courses.

10. A textile fabric for dissipating electrical charges according to claim 9, wherein the electrically conductive yarns are interknitted with one another at the intersections therebetween.

11. A textile fabric for dissipating electrical charges according to claim 10, wherein the yarns of the knitted structure and the electrically conductive yarns are warp knitted with one another.

12. A textile fabric for dissipating electrical charges according to claim 11, wherein the knitted structure is a warp knitted construction comprising two sets of ground yarns warp knitted in substantially every wale and course in a dimensionally stable stitch pattern and two sets of electrically conductive yarns warp knitted in only selected wales and courses.

13. A textile fabric for dissipating electrical charges according to claim 12, wherein one set of the ground yarns is warp knitted in a repeating 1-0,3-4 stitch pattern, the other set of ground yarns is warp knitted in a repeating 1-2,1-0 stitch pattern, one set of the electrically conductive yarns is warp knitted in a repeating (1-0,0-1)×2, 1-2,2-3, (3-4,4-3)×2, 3-2,2-1 stitch pattern, and the other set of electrically conductive yarns is warp knitted in a repeating (3-4,4-3)×2, 3-2,2-1, (1-0,0-1)×2, 1-2,2-3 stitch pattern.

* * * * *